US008801581B2

(12) United States Patent
Lai et al.

(10) Patent No.: US 8,801,581 B2
(45) Date of Patent: Aug. 12, 2014

(54) TREADMILL FOLDABLE INTO A CHAIR

(75) Inventors: Wei-Chen Lai, Taichung (TW); Jia-Zih Jheng, Taichung (TW); Chi-Ashen Huang, Taichung (TW)

(73) Assignee: American Motion Fitness Products Inc., Taichung (TW)

( * ) Notice: Subject to any disclaimer, the term of this patent is extended or adjusted under 35 U.S.C. 154(b) by 618 days.

(21) Appl. No.: 13/099,565

(22) Filed: May 3, 2011

(65) Prior Publication Data

US 2012/0283070 A1 Nov. 8, 2012

(51) Int. Cl.
*A63B 22/02* (2006.01)
*A63B 26/00* (2006.01)

(52) U.S. Cl.
USPC ..... 482/54; 482/142

(58) Field of Classification Search
CPC ..... A63B 2210/50; A63B 22/02; F03G 5/025
USPC ..... 482/51, 54, 142, 148
See application file for complete search history.

(56) References Cited

U.S. PATENT DOCUMENTS

| | | | | |
|---|---|---|---|---|
| 3,193,287 | A * | 7/1965 | Robinson | 482/54 |
| 3,589,715 | A * | 6/1971 | Mark et al. | 482/142 |
| 3,826,491 | A * | 7/1974 | Elder | 482/7 |
| 3,870,297 | A * | 3/1975 | Elder | 482/7 |
| 4,762,363 | A * | 8/1988 | Hart | 297/118 |
| 4,815,732 | A * | 3/1989 | Mahvi | 482/142 |
| 4,869,493 | A * | 9/1989 | Johnston | 482/54 |
| 4,925,183 | A * | 5/1990 | Kim | 482/61 |
| 5,050,899 | A * | 9/1991 | Stensby | 280/250.1 |
| 5,135,458 | A * | 8/1992 | Huang | 482/138 |
| 5,382,033 | A * | 1/1995 | Cheu | 280/87.051 |
| 5,411,279 | A * | 5/1995 | Magid | 280/47.38 |
| 5,437,588 | A * | 8/1995 | Abboudi et al. | 482/54 |
| 5,492,521 | A * | 2/1996 | Wilkinson et al. | 482/147 |
| 5,681,250 | A * | 10/1997 | Hoover et al. | 482/142 |
| 6,450,923 | B1 * | 9/2002 | Vatti | 482/8 |
| 6,878,101 | B2 * | 4/2005 | Colley | 482/54 |
| 7,410,449 | B2 * | 8/2008 | Yeh | 482/57 |
| 7,594,878 | B1 * | 9/2009 | Joannou | 482/54 |
| 7,780,578 | B2 * | 8/2010 | Packham | 482/54 |
| 7,892,148 | B1 * | 2/2011 | Stauffer et al. | 482/54 |
| 7,892,150 | B1 * | 2/2011 | Colley | 482/54 |
| 2006/0247109 | A1 * | 11/2006 | Powell | 482/148 |
| 2008/0194389 | A1 * | 8/2008 | Southerland | 482/54 |
| 2010/0298102 | A1 * | 11/2010 | Bosecker et al. | 482/54 |
| 2012/0088633 | A1 * | 4/2012 | Crafton | 482/1 |
| 2012/0264573 | A1 * | 10/2012 | Hsu | 482/54 |

* cited by examiner

*Primary Examiner* — Stephen Crow
(74) *Attorney, Agent, or Firm* — Rosenberg, Klein & Lee

(57) ABSTRACT

A treadmill foldable into a chair includes a treadmill body having a base and a treadmill belt wound around the base, a stand having left and right symmetric support frames, and the bottom of the two support frames being pivotally coupled to the base by a pivot portion, and a meter installed at the top of the stand for adjusting and controlling an exercise status of the treadmill body, such that when the treadmill body is being used, the stand is erected at a front section of the base. The treadmill further includes a backrest installed between the two support frames, such that when the stand is folded towards the rear by using the pivot portion as an axial center, the stand is converted into a chair disposed on the base. The invention provides a two-in-one function and serves as a chair when not being used as a treadmill.

9 Claims, 7 Drawing Sheets

TREADMILL FOLDABLE INTO A CHAIR

BACKGROUND OF THE INVENTION (a) Field of the Invention

The present invention relates to a treadmill, and more particularly to a treadmill foldable into a chair when not in use, such that the treadmill comes with a two-in-one structure.

(b) Description of the Related Art

Some conventional treadmills are used in fitness centers, and most of them are used at home. However, the interior space of a home is very limited and it is quite difficult to have a separate fitness gym at home, so that the treadmill is usually set up in living rooms. However, the conventional treadmill 10 as shown in FIG. 1 comprises a base 11, a frame 12 and a stand 13, having a length over 100 cm and occupying a relatively large space, so that furniture such as a sofa cannot be put after the conventional treadmill 10 is installed. Therefore, some treadmills are manufactured with a downwardly foldable design or the frame 12 is manufactured with an upwardly liftable design to reduce the occupied space.

For example, a fold-out treadmill with a foldable structure is disclosed in U.S. Pat. Nos. 5,899,834, 6,350,218, 7,192,388 and 6,033,347 issued to Icon Health & Fitness, Inc (US); a foldable treadmill is disclosed in U.S. Pat. No. 5,855,537 issued to FF Acquisition Corp.; and other foldable treadmills are disclosed in U.S. Pat. Nos. 5,746,682, 6,872,169 and 7,727,122.

Although the foregoing disclosed foldable treadmills, regardless of those having a downwardly foldable stand or an upwardly liftable frame, can achieve the effect of reducing the total volume of the treadmill, yet the treadmills still occupy much space and have the difficulty to be placed in the living room. Obviously, the conventional foldable treadmills require improvements.

SUMMARY OF THE INVENTION

Therefore, it is a primary objective of the present invention to provide a treadmill foldable into a chair and having a two-in-one function for switching to a treadmill or a chair by a simple and convenient operation.

Another objective of the present invention is to provide a treadmill foldable into a chair, and the chair can be adjusted to a desired angle as needed.

To achieve the foregoing objects, the present invention adopts the following technical measures:

a treadmill body, having a base and a treadmill belt wound around the base; and a stand, having left and right symmetric support frames, and the bottom of the two support frames being pivotally coupled to the base by a pivot portion, and a meter installed at the top of the stand for adjusting and controlling an exercise status of the treadmill body, such that when the treadmill body is situated at a using status, the stand is erected at a front section of the base;

characterized in that a backrest is installed between the two support frames, such that when the stand is folded towards the rear by using the pivot portion as an axial center, the stand is converted into a chair disposed on the base.

Moreover, in the treadmill of the present invention, the two support frames of the stand further include a buffer element, and a front end of the buffer element is pivotally installed at an internal side of the bottom of the support frames, and a rear end of the buffer element is pivotally installed on the base. The buffer element is comprised of a pressure bar, and the pivot portion at the bottom of the support frames is comprised of a shaft coupled to the base and the support frames.

Furthermore, the bottom of the two support frames of the stand further include a positioning device installed at the periphery of the pivot portion, and the positioning device includes a latch pin protruded from the internal side of the bottom of the support frames and at least one positioning hole formed on the base and provided for extending and latching the latch pin to fix the stand at a predetermined position.

With the aforementioned technical characteristics of the present invention, the treadmill can be folded into a chair in the same place by adjusting the stand and without moving the base. The invention maximizes the utility of space and structural conversion to achieve a two-in-one effect.

DETAILED DESCRIPTION OF THE PREFERRED EMBODIMENT

Figure 1:
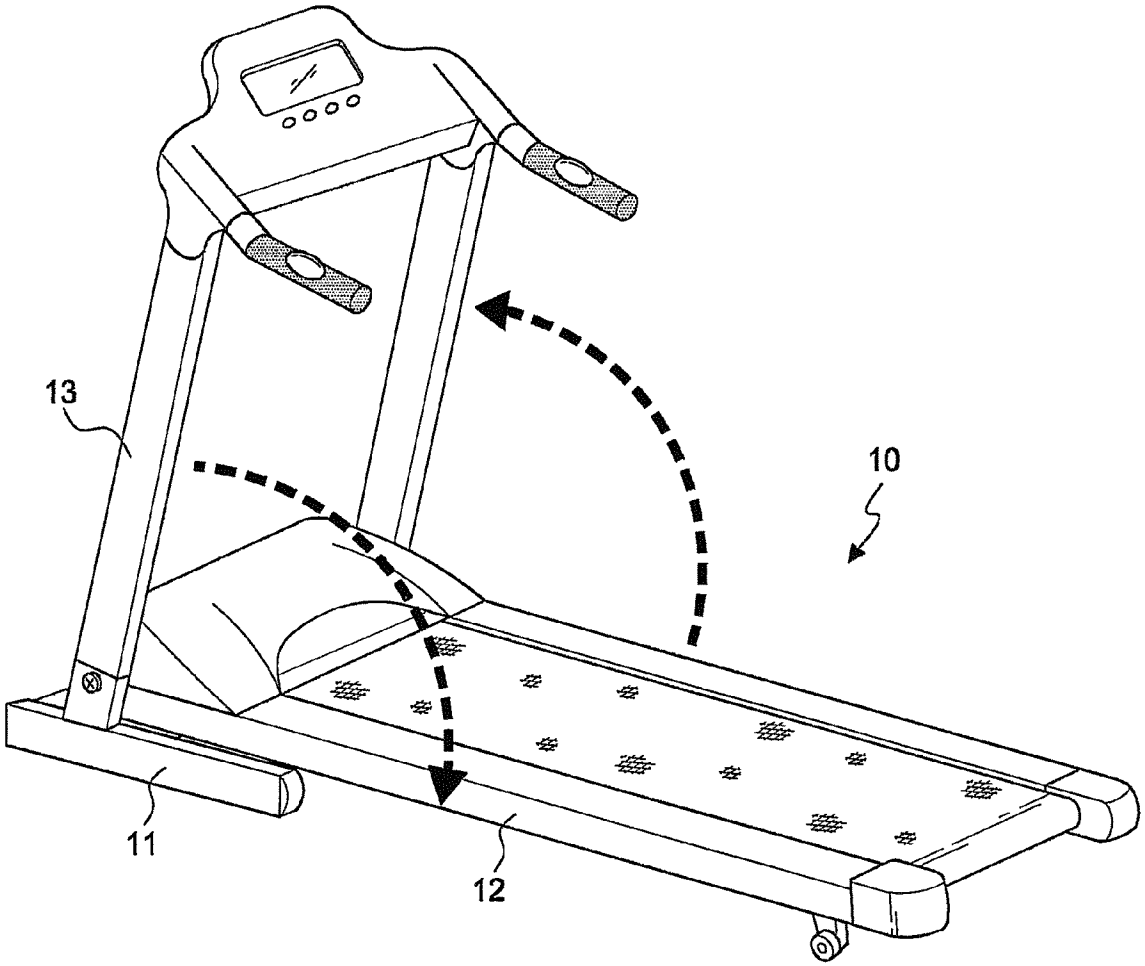
FIG. 1 PRIOR ART
FIG. 1 is a perspective view of a conventional treadmill.
Figure 2:
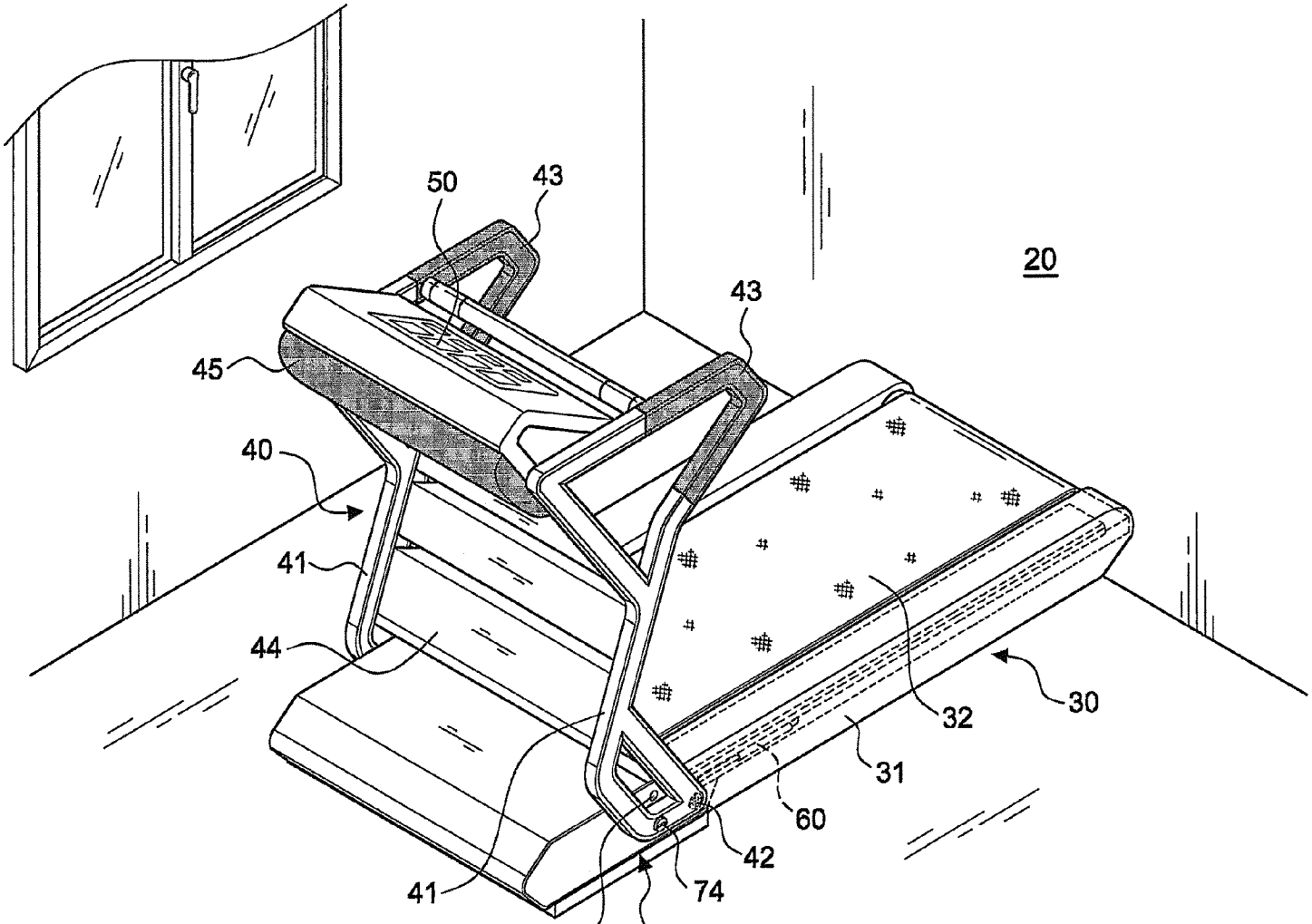
FIG. 2 is a perspective view of a preferred embodiment of the present invention.
Figure 3:
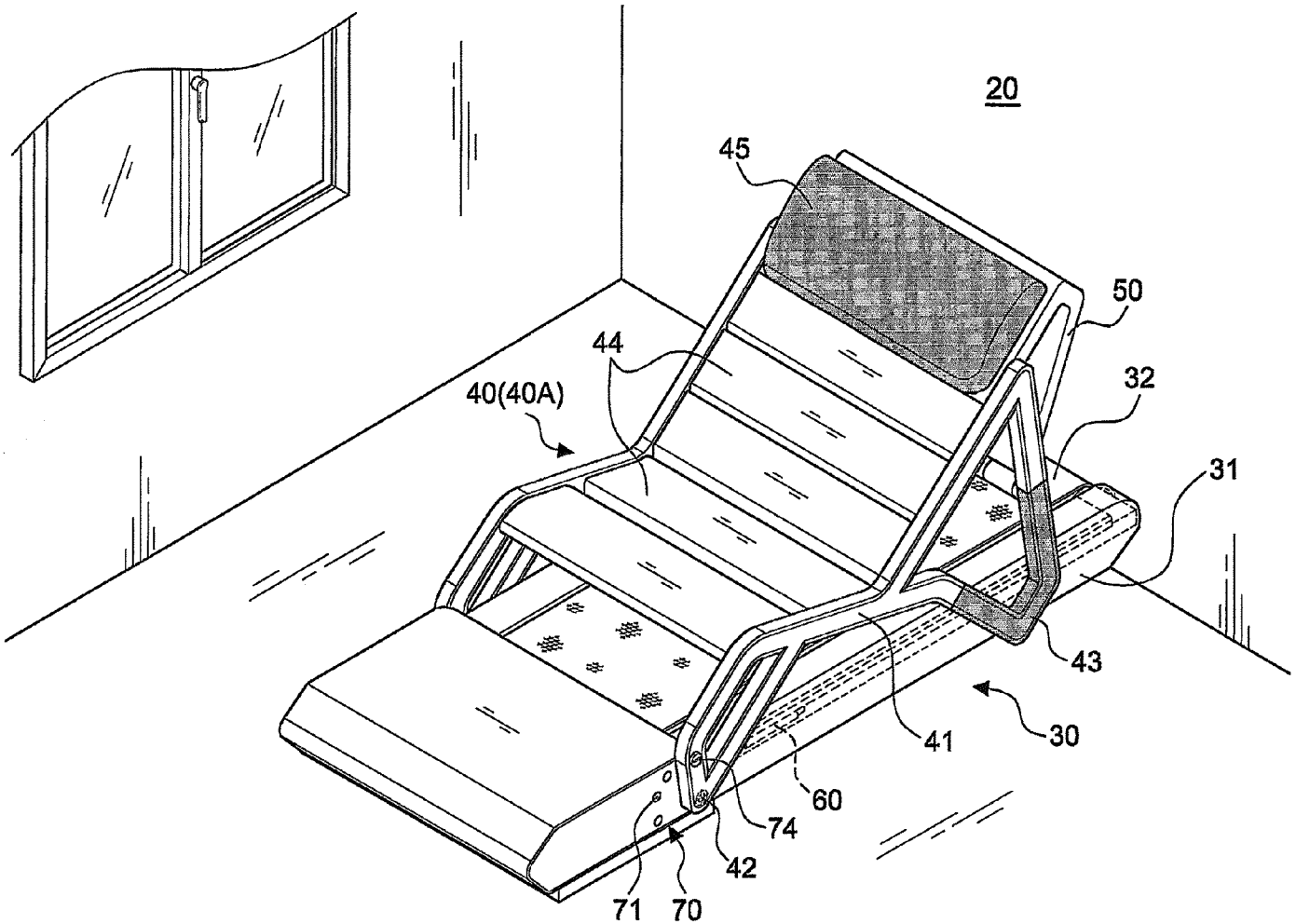
FIG. 3 is a perspective view of a treadmill foldable into a chair in accordance with the present invention.
Figure 4:
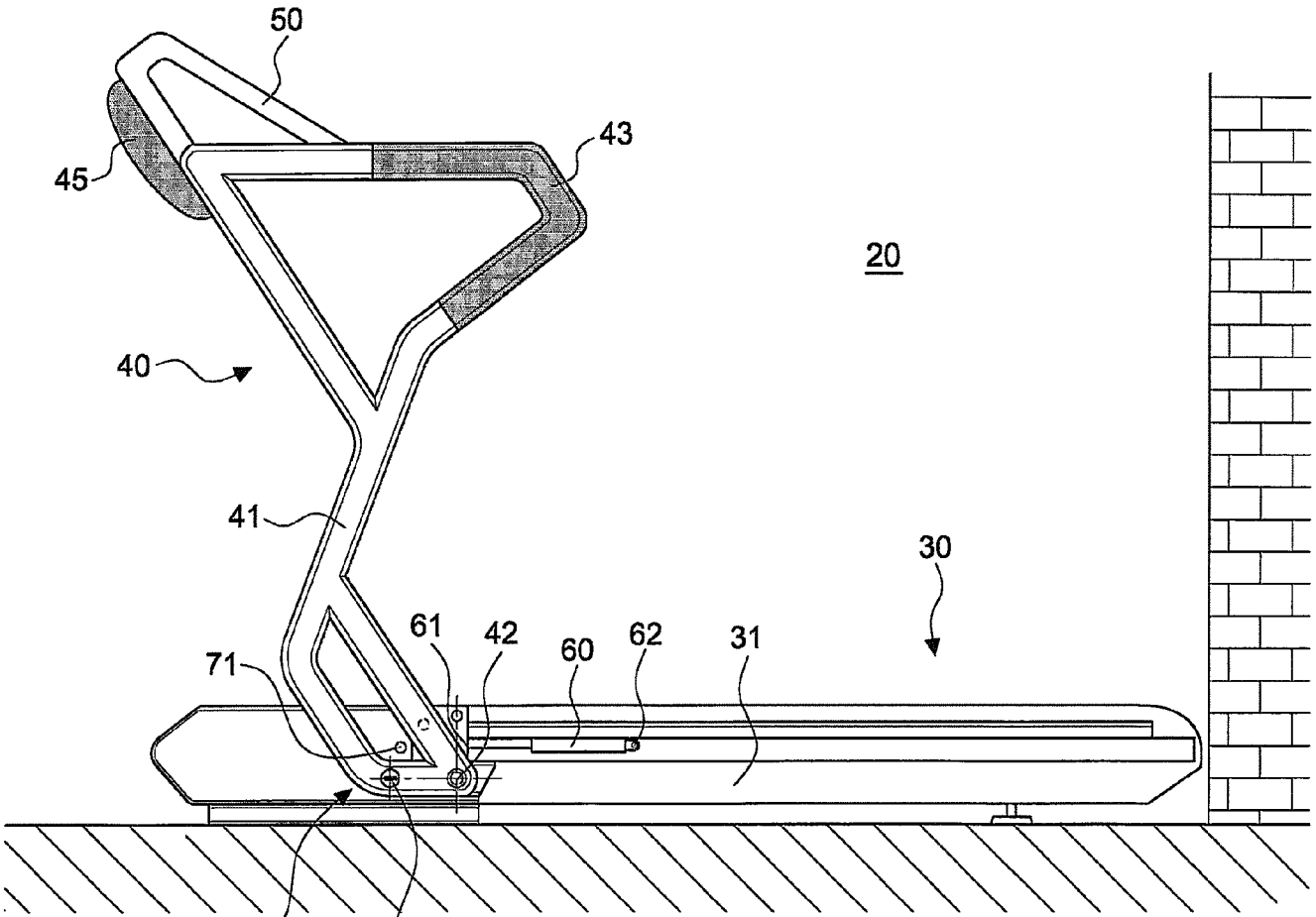
FIG. 4 is a side view of an unfolded status of a treadmill in accordance with the present invention.

With reference to FIGS. 2 to 7 for a treadmill 20 in accordance with a preferred embodiment of the present invention, the treadmill 20 comprises:

a treadmill body 30, having a base 31, and a treadmill belt 32 wound around the base 30, wherein the treadmill 20 of the present invention can be a flat treadmill or an electric treadmill, so that transmission components can be installed in the base 31 as needed; however, the installation of the transmission components is a prior art, and thus will not be described in details here; and a stand 40, having left and right symmetric support frames 41, and the bottom of the two support frames 41 being pivotally installed on the base 31 by a pivot portion 42, and a meter 50 installed at the top of the stand 40 for adjusting and controlling an exercise status of the treadmill body 30, such that when the treadmill body 30 is used, the stand 40 is erected at a front section of the base 31 as shown in FIGS. 2 and 4.

The present invention is characterized in that the two support frames 41 of the stand 40 include a protrusion 43 inwardly extended from another end of the pivot portion 42, and the protrusion 43 is not limited to any particular shape and preferably can serve as a handle when the stand 40 is erected. In addition, a backrest 44 is installed between the two support frames 41, such that when the stand 40 is folded towards the rear by using the pivot portion 42 as an axial center, the stand 40 is converted into a structure of a chair 40A disposed on the base 31.

In this preferred embodiment, a buffer element 60 is installed at the bottom of the two support frames 41 of the stand 40, and a front end 61 of the buffer element 60 is pivotally installed to an internal side of the bottom of the support frames 41, and a rear end 62 of the buffer element 60 is pivotally installed on the base 31. In this preferred embodiment, the buffer element 60 includes but not limited to a pressure bar, and any equivalent elastic element can be used instead. The main purpose is to descend the stand 40 slowly when the stand 40 is folded. Further, the pivot portion 42 at the bottom of the support frames 41 is comprised of a shaft 42 coupled to the base 31 and the support frame 41.

The backrest 44 can be a board made of a hard, elastic, or soft material, and manufactured in a form of a mesh body, a cushion body, or a combined structure. The backrest 44 can be installed between the two support frames 41 or integrated with the support frames 41. In this preferred embodiment, the stand 40 includes a headrest 45 disposed at the front side of the meter 50.

With the foregoing disclosed technical characteristics of the treadmill 20 of the present invention, a positioning device 70 can be installed at the periphery of the pivot portion 42 at the bottom of the two support frames 41 of the stand 40. In FIG. 7, the positioning device 70 includes a latch pin 72 protruded from the internal side of the bottom of the support frames 41 and at least one positioning hole 71 formed at the base 31 and provided for extending and latching the latch pin 72 to fix the stand 40 at a predetermined position. In this preferred embodiment as shown in FIGS. 2 to 6, there are a plurality of positioning holes 71 arranged equidistantly into an arc shape by using the pivot portion 42 as a center, and the latch pin 71 includes a spring 73 sheathed thereon, such that when the latch pin 72 is aligned precisely with any one of the positioning holes 71, the latch pin 72 is elastically latched into the positioning hole 71, and the latch pin 72 includes an operating interface 74 disposed at an external side of the latch pin 72.

Further, a flange 721 is formed at the middle section of the latch pin 72, such that the spring 73 can force the latch pin 72 inwardly to provide an elastic latching force, and the operating interface 74 is a positioning knob or a fixing element provided for controlling the latch pin 72, such that the latch pin 72 can be latched to or detached from the positioning hole 71 smoothly.

Figure 5:
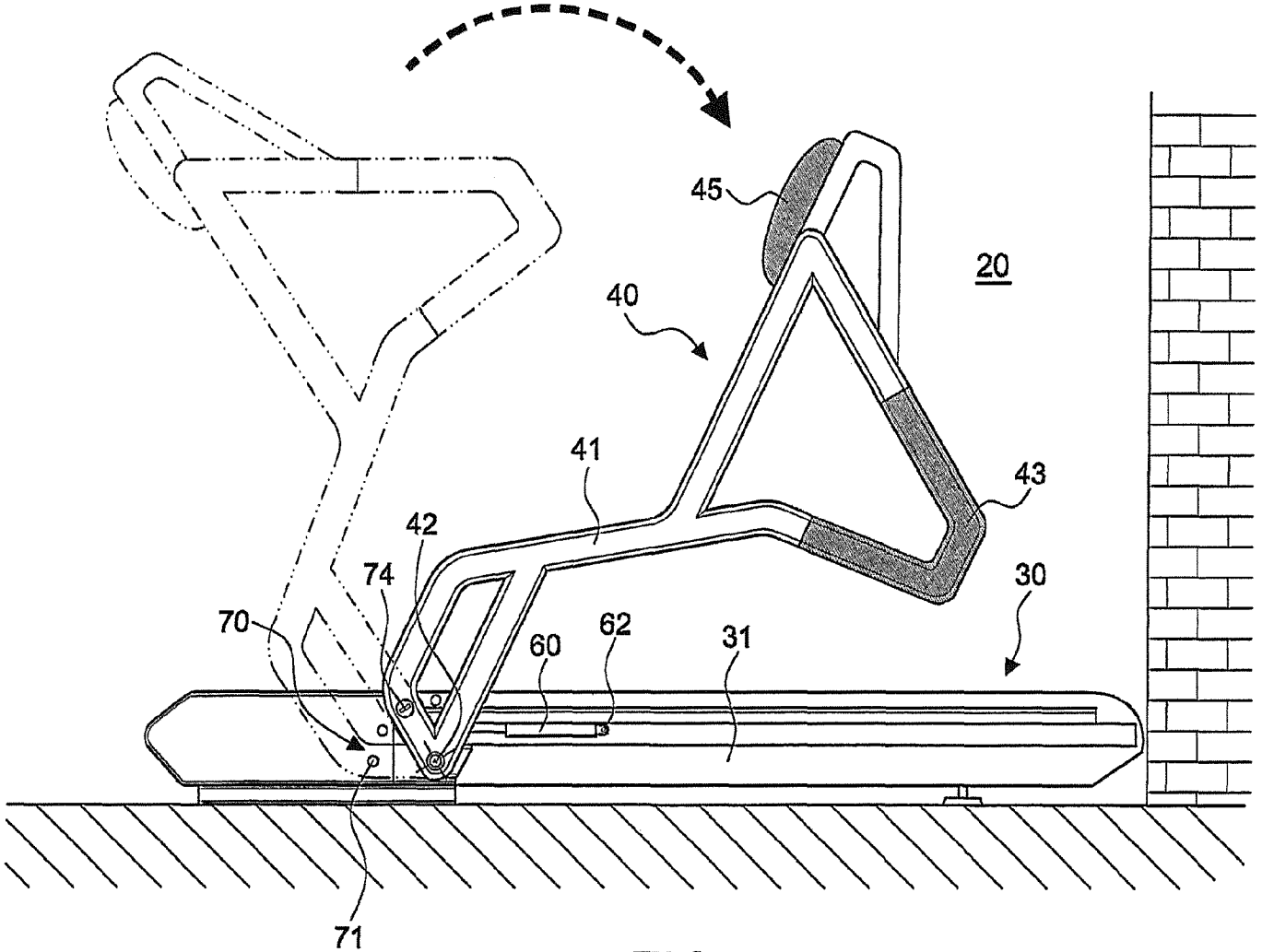
FIG. 5 is a side view of a using status of a treadmill folded into a chair in accordance with the present invention.
Figure 6:
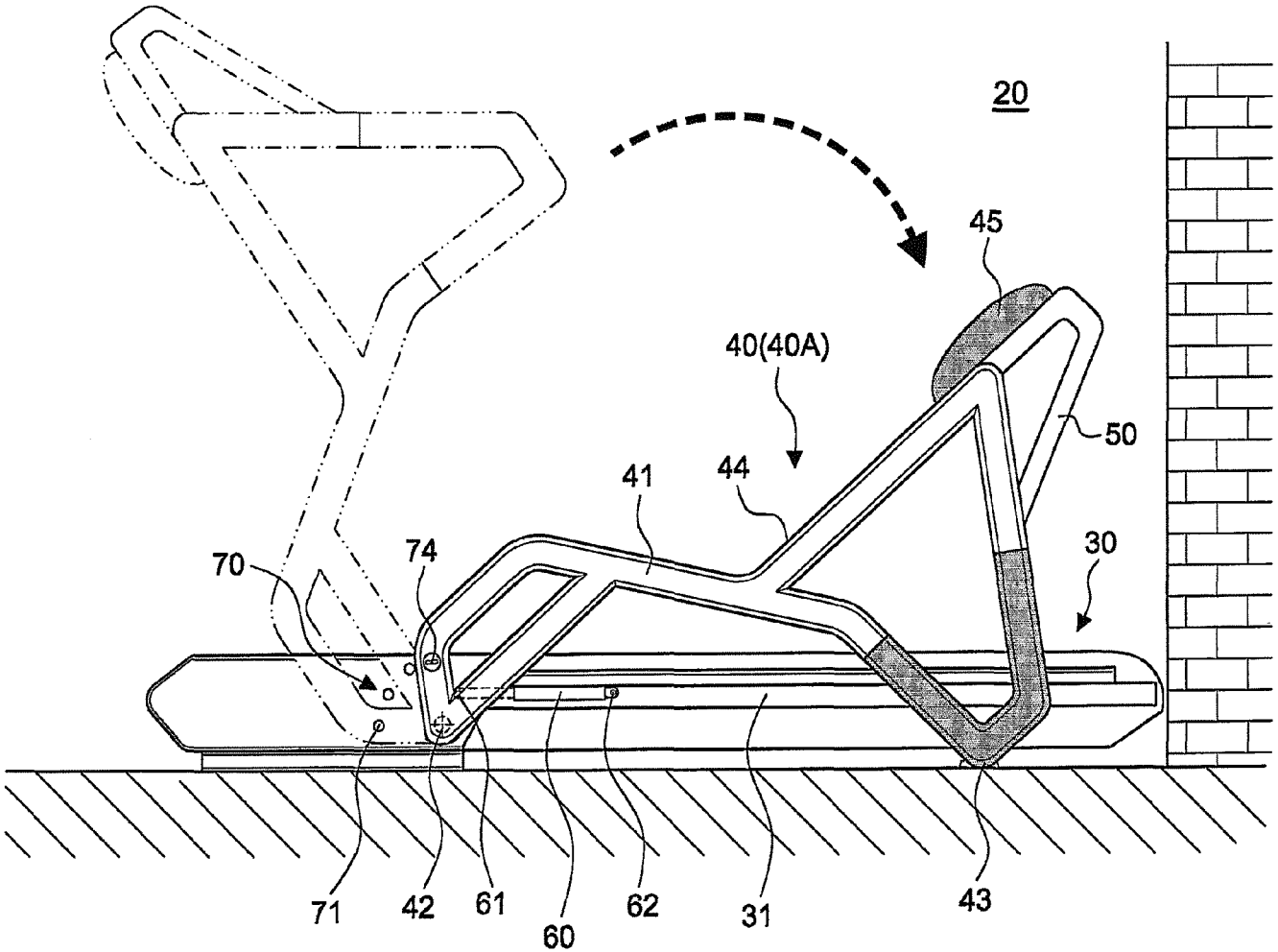
FIG. 6 is a side view of another using status of a treadmill folded into a chair in accordance with the present invention.
Figure 7:
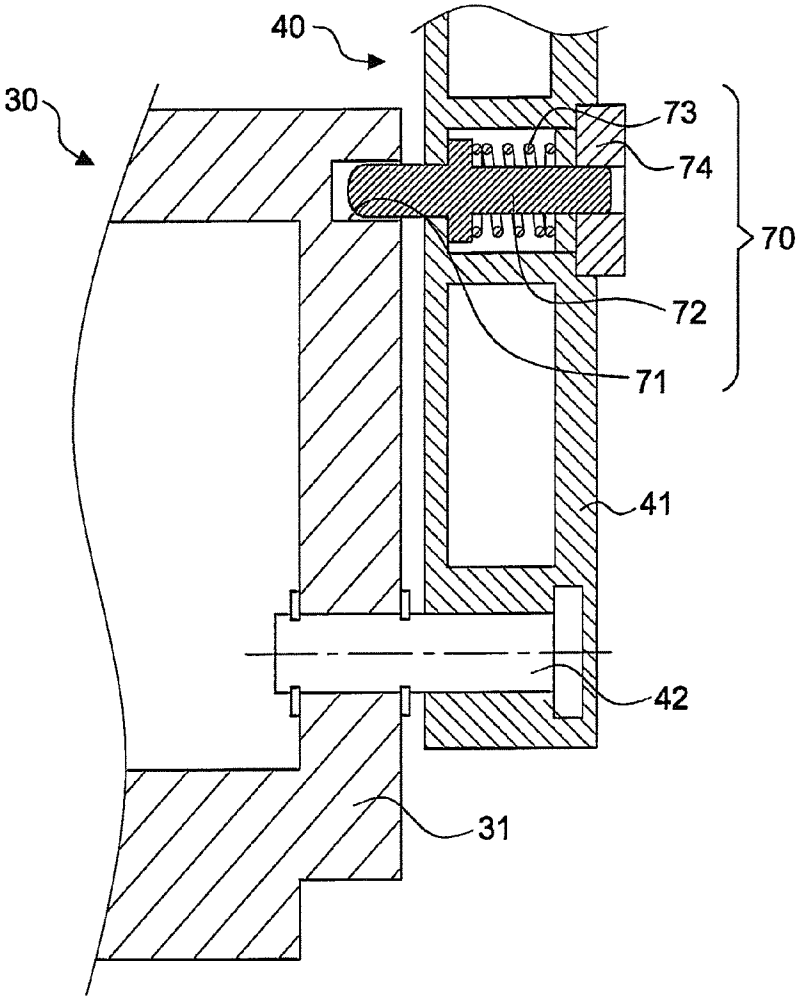
FIG. 7 is a cross-sectional view of a positioning device of the present invention.

In FIG. 6, the latch pin 72 is latched to the position of the positioning hole 71, such that the protrusion 43 of the support frame 41 of the stand 40 can abut against the ground, and the chair 40A becomes a sling chair. Of course, the latch pin 72 can also be latched to the position of the positioning hole 71 as shown in FIG. 5, such that the protrusion 43 of the support frame 41 of the stand 40 can be suspended in air without touching the ground, and the chair 40A becomes a rocking chair.

With the aforementioned technical characteristics of the present invention, the treadmill 20 can be placed at a corner of a living room without occupying much space. The treadmill can be folded into a chair 40A, when it is not used as a treadmill. The invention not only provides a convenient operation, but also merges the treadmill into our household living and maximizes the utility of space and structural conversion to achieve a two-in-one effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill foldable into a chair, comprising:

a treadmill body, having a base and a treadmill belt wound around the base;

a stand, having left and right symmetric support frames, and the bottom of the two support frames being pivotally coupled to the base by a pivot portion, and a control mechanism installed at the top of the stand for adjusting and controlling an exercise status of the treadmill body, such that when the stand is erected at a front section of the base, the treadmill body is in a treadmill configuration; and a backrest installed between the two support frames, such that when the stand is folded towards the rear by using the pivot portion as an axial center, the stand is converted into a chair disposed on the base.

2. The treadmill foldable into a chair as recited in claim 1, wherein the two support frames of the stand further include a buffer element, and a front end of the buffer element is pivotally installed at an internal side of the bottom of the support frames, and a rear end of the buffer element is pivotally installed on the base.

3. The treadmill foldable into a chair as recited in claim 2, wherein the buffer element is comprised of a pressure bar, and the pivot portion at the bottom of the support frames is comprised of a shaft coupled to the base and the support frames.

4. The treadmill foldable into a chair as recited in claim 1, wherein the bottom of the two support frames of the stand further include a positioning device installed at the periphery of the pivot portion, and the positioning device includes a latch pin protruded from the internal side of the bottom of the support frames and at least one positioning hole formed on the base and provided for extending and latching the latch pin to fix the stand at a predetermined position, and another end of the two support frames away from the pivot portion includes an inwardly extended protrusion.

5. The treadmill foldable into a chair as recited in claim 4, wherein the positioning device includes a plurality of positioning holes formed on the base, and the positioning holes are distributed equidistantly in an arc shape with respect to the pivot portion as the center, and the latch pin includes a spring sheathed thereon, such that when the latch pin is aligned precisely with any one of the positioning holes, the latch pin is elastically latched to the positioning hole, and the latch pin includes an operating interface disposed at an external side of the latch pin.

6. The treadmill foldable into a chair as recited in claim 5, wherein the latch pin is latched to the position of the positioning hole and provided for pressing the protrusion of the support frames of the stand against the ground.

7. The treadmill foldable into a chair as recited in claim 5, wherein the latch pin is latched to the position of the positioning hole and provided for keeping the protrusion of the support frames of the stand to be suspended in air without touching the ground.

8. The treadmill foldable into a chair as recited in claim 1, wherein the backrest mounted on the support frames of the stand is a board made of a hard, elastic, or soft material, and manufactured in a form of a mesh body, a cushion body, or a combined structure.

9. The treadmill foldable into a chair as recited in claim 8, wherein the stand includes a headrest disposed at the front side of the control mechanism.

* * * * *